US011103907B2

(12) United States Patent
Ante et al.

(10) Patent No.: US 11,103,907 B2
(45) Date of Patent: Aug. 31, 2021

(54) DEVICE AND METHOD FOR DESCALING A WORKPIECE IN MOTION

(71) Applicant: SMS Group GmbH, Duesseldorf (DE)

(72) Inventors: Angela Ante, Hilchenbach (DE); Jan Schroeder, Hilchenbach (DE); Jens Marburger, Erndtebrück (DE); Wolfgang Fuchs, Hilchenbach (DE); Michael Jarchau, Oelde (DE)

(73) Assignee: SMS GROUP GMBH, Dusseldorf (DE)

( * ) Notice: Subject to any disclaimer, the term of this patent is extended or adjusted under 35 U.S.C. 154(b) by 276 days.

(21) Appl. No.: 16/085,013

(22) PCT Filed: Mar. 14, 2017

(86) PCT No.: PCT/EP2017/055996

§ 371 (c)(1),
(2) Date: Sep. 14, 2018

(87) PCT Pub. No.: WO2017/157940

PCT Pub. Date: Sep. 21, 2017

(65) Prior Publication Data

US 2019/0076900 A1 Mar. 14, 2019

(30) Foreign Application Priority Data

Mar. 18, 2016 (DE) ..... 10 2016 204 570.9
Mar. 18, 2016 (DE) ..... 10 2016 204 579.2
(Continued)

(51) Int. Cl.
*B21B 45/08* (2006.01)
*B08B 3/02* (2006.01)
(Continued)

(52) U.S. Cl.
CPC ..... *B21B 45/08* (2013.01); *B05B 13/0484* (2013.01); *B05B 14/30* (2018.02);
(Continued)

(58) Field of Classification Search
CPC ..... B08B 3/022; B08B 3/024; B05B 13/0421; B05B 13/0484; B21B 45/08
See application file for complete search history.

(56) References Cited

U.S. PATENT DOCUMENTS 3,510,065 A * 5/1970 Gigantino ..... B21B 45/08 239/590
4,918,959 A * 4/1990 Parazak ..... B21B 45/08 72/39
(Continued)

FOREIGN PATENT DOCUMENTS

DE 4328303 6/1994
DE 4302331 8/1994
(Continued)

*Primary Examiner* — Christopher M Koehler
(74) *Attorney, Agent, or Firm* — Abelman, Frayne & Schwab

(57) ABSTRACT

Device and method for descaling a workpiece that is in motion in relation to the device in a movement direction. The device includes a rotor head rotatable about a rotational axis and inclined diagonally at an angle (Y) with respect to an orthogonal on a surface of the workpiece. The device includes jet nozzles attached to the rotor head which dispense a pressurized liquid onto the workpiece at an angle of attack (α) inclined to the workpiece surface. The nozzles are fixedly attached on the rotor head such that during rotation of the rotor head about its axis of rotation, the spraying direction of the liquid dispensed from the nozzles with respect to a projection in a plane parallel to the surface of the workpiece, is aligned opposing to and at a spraying angle (β)
(Continued)

of approximately between 170 and 190 degrees to the movement direction of the workpiece.

21 Claims, 12 Drawing Sheets

(30) Foreign Application Priority Data

Sep. 14, 2016 (DE) ..... 10 2016 217 560.2
Sep. 14, 2016 (DE) ..... 10 2016 217 561.0
Sep. 14, 2016 (DE) ..... 10 2016 217 562.9

(51) Int. Cl.
*B05B 13/04* (2006.01)
*B05B 14/30* (2018.01)
*B21B 38/00* (2006.01)

(52) U.S. Cl.
CPC ..... *B08B 3/022* (2013.01); *B05B 13/0421* (2013.01); *B08B 2203/0264* (2013.01); *B21B 38/00* (2013.01); *B21B 2038/004* (2013.01); *B21B 2275/06* (2013.01)

(56) References Cited

U.S. PATENT DOCUMENTS 5,388,602 A * 2/1995 Coassin ..... B21B 45/08 134/122 R
5,502,881 A * 4/1996 Gaydoul ..... B05B 3/027 29/81.08
5,697,241 A * 12/1997 Djumlija ..... B21B 45/08 72/39
6,029,681 A * 2/2000 Gaydoul ..... B21B 45/08 134/56 R
6,149,733 A 11/2000 Djulija
7,958,609 B2 * 6/2011 Gaydoul ..... B21B 45/08 29/81.08
8,479,550 B2 7/2013 Eckerstorfer
2007/0277358 A1 * 12/2007 Gaydoul ..... B05B 13/0484 29/81.08
2012/0048501 A1 3/2012 Bilgen
2012/0216839 A1 * 8/2012 Tung ..... B21B 45/08 134/34
2016/0303627 A1 10/2016 Kramer
2018/0043408 A1 * 2/2018 Nakano ..... B24C 3/12

FOREIGN PATENT DOCUMENTS

DE 19817002 10/1999
DE 102014109160 12/2015
JP 11216513 8/1999

* cited by examiner $S_1 > S_2 > S_3$ $\dot{V}_1 > \dot{V}_2 > \dot{V}_3$

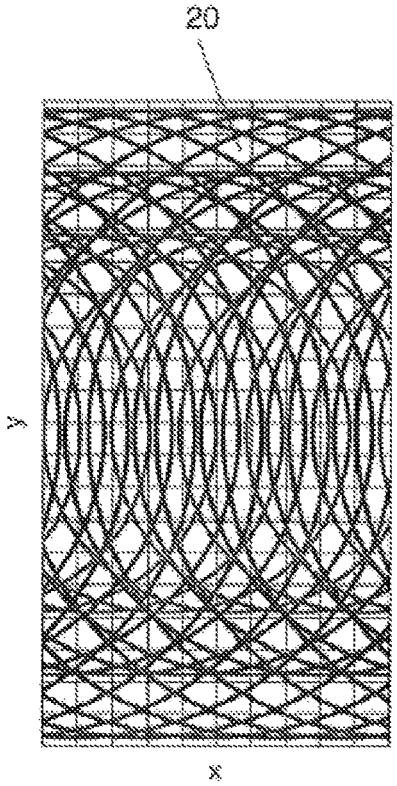
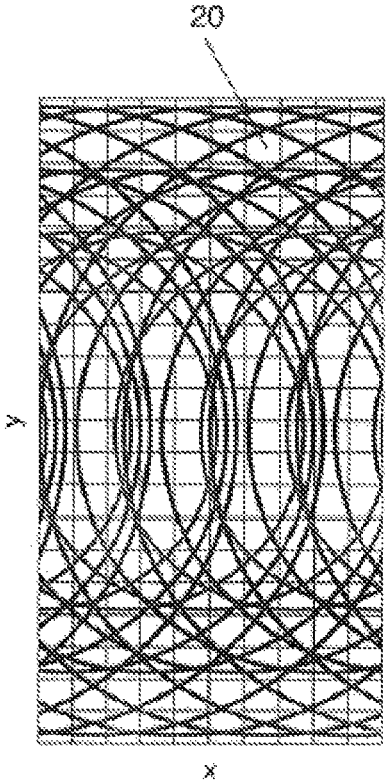
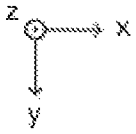
Fig. 9a
Fig. 9b

DEVICE AND METHOD FOR DESCALING A WORKPIECE IN MOTION

CROSS-REFERENCE TO RELATED APPLICATIONS

This application is a National phase application of an International application PCT/EP2017/055996 filed Sep. 14, 2017 and claiming priority of German applications DE 10 2016 217 560.2 filed Sep. 14, 2016, DE 10 2016 217 561.2 filed Sep. 14, 2016, DE 10 2016 217 562.9 filed Sep. 14, 2016, DE 10 2016 204 5709 filed Mar. 18, 2016, and DE 10 2016 204 529.2 filed Mar. 18, 2016, all of the above-mentioned applications are incorporated herein by reference thereto.

FIELD OF INVENTION

The invention relates to a device and a method for descaling a workpiece that is in motion in relation to the device in a movement direction. The workpiece is in particular a hot rolled stock.

DESCRIPTION OF RELATED ART

To descale workpieces, in particular hot rolled stock, spraying water at high pressure onto the surface of the workpiece is known according to the prior art. For continuous descaling of the surfaces of the workpiece, the high-pressure sprayed water is generally sprayed out of multiple nozzles of a descaler. In this context, a descaler in a hot rolling facility refers to an assembly which is provided for removing scale, i.e., contaminants made of iron oxide, from the surface of the rolled stock.

A descaler is known from WO 2005/082555 A1 using which a rolled stock in motion in relation to the descaler is descaled by blasting by means of high-pressure sprayed water. This descaler comprises at least one row of nozzle heads, which sweeps over the rolled stock width, having multiple nozzle heads, wherein each nozzle head is rotationally driven by a motor about an axis of rotation perpendicular to the rolled stock surface. Furthermore, at least two nozzles arranged off-center with respect to the axis of rotation are provided in each nozzle head, which are arranged as close as structurally possible on the circumference of the nozzle head. Such a descaler is subject to the disadvantage that an energy introduction over the width of the rolled stock can have inhomogeneities, and therefore lasting temperature strips occur on the rolled stock in the overlap region of adjacent nozzle heads. Furthermore, the nozzles on the respective nozzle heads are inclined outward by an angle of attack, which is illustrated in FIG. 13. This has the result that the spraying direction of these nozzles is also aligned in the direction of the feed of the rolled stock during a rotation of the nozzle heads about the axis of rotation thereof. Such an alignment of the high-pressure sprayed water discharged from the nozzles is disadvantageous insofar as in this case the jet of the sprayed water is ineffective and therefore does not provide a contribution to descaling the surface of the rolled stock.

A method for descaling rolled stock is known from WO 1997/27955 A1, in which a rotor descaling device is provided, by means of which a liquid jet is sprayed onto a surface to be descaled of the rolled stock. To ensure only slight cooling of the rolled stock and to create high jet pressures at low operating liquid pressure, the liquid jet is formed intermittently, i.e., temporarily stopping. Because of the interruption of the liquid jet once or multiple times, pressure peaks arise, which act as a jet pressure enhancement, whereby an improvement of the descaling effect for the rolled stock is achieved. A control disk provided for this purpose, which is provided in fluid connection with a pressure medium supply line, disadvantageously increases the structural expenditure for this descaling technology, however. Furthermore, the risk of increased material strain, in particular due to cavitation, arises upon the formation of the pressure peaks.

A device of the type in question and a method of the type in question for descaling a workpiece, which is in motion in a movement direction in relation to the device, are known from DE 10 2014 109 160 A1. For this purpose, multiple jet nozzles are provided on a rotating rotor head in the form of a nozzle holder, wherein liquid is discharged or sprayed under high pressure from the jet nozzles onto a surface of the rolled stock such that in this case the emission direction in which the liquid is sprayed from the jet nozzles always extends at an angle inclined to the movement direction of the rolled stock. Due to this inclined alignment of the discharge direction, removed scale is transported away from the rolled stock to the side from the surface of the rolled stock. However, a disadvantageously strong soiling of the facility and/or its surrounding area accompanies this.

SUMMARY OF INVENTION

The invention is based on the object of optimizing the descaling of a workpiece using simple means and reducing the demand for energy and the quantity of water required for this purpose.

This object is achieved by a device having the features defined in claim 1, and by a method having the features defined in claim 10. Advantageous refinements of the invention are defined in the dependent claims.

A device according to the present invention is used for descaling a workpiece moved in a movement direction in relation to the device, preferably a hot rolled stock, and comprises at least one rotor head rotatable about an axis of rotation, on which multiple jet nozzles are attached, wherein a liquid, in particular water, can be dispensed onto the workpiece at an angle of attack inclined relative to the surface of the workpiece from the jet nozzles. For this purpose, the jet nozzles are attached on the rotor head in such a way that during rotation of the rotor head about its axis of rotation, the spraying direction of the liquid distributed from the jet nozzles, with respect to a projection in a plane parallel to the surface of the workpiece, is aligned permanently opposed, i.e., at a spraying angle between 170° and 190°, preferably at a spraying angle of 180°, to the movement direction of the workpiece and at the same time the angle of attack for all jet nozzles remains consistently equal. The device comprises a collection unit, which is arranged upstream from the rotor head with respect to the movement direction of the rolled stock in such a way that both the liquid dispensed from the jet nozzles after rebounding from the surface of the workpiece and also the scale removed from the surface of the workpiece by means of the liquid are introducible in a targeted manner into this collection unit.

In the same manner, the invention also provides a method for descaling a workpiece, preferably a hot rolled stock. For this purpose, the workpiece is in motion in relation to a device in a movement direction, wherein this device has at least one rotor head rotatable about an axis of rotation, on which multiple jet nozzles are attached. While the rotor head is rotated about its axis of rotation, a liquid, in particular water, is dispensed or sprayed onto the workpiece at an angle of attack inclined to the surface of the workpiece. During rotation of the rotor head about its axis of rotation, the spraying direction of the liquid dispensed from the jet nozzles, in relation to a projection in a plane parallel to the surface of the workpiece, is aligned permanently opposed, i.e., at a spraying angle between 170° and 190°, preferably at a spraying angle of 180°, to the movement direction of the workpiece, wherein the angle of attack for all jet nozzles remains consistently equal. Furthermore, both the liquid dispensed from the jet nozzles after rebounding from the surface of the workpiece and also the scale removed from the surface of the workpiece by means of the liquid are introduced in a targeted manner into a collection unit.

The invention is based on the essential finding that it is possible by means of the arrangement of the rotor head in relation to the movement direction of the workpiece and the attachment of the jet nozzles on the rotor head to align the liquid dispensed from the jet nozzles permanently and preferably precisely opposing the movement direction of the workpiece, namely in relation to a or in a projection of the spraying direction of this liquid in a plane parallel to the surface of the workpiece. As a result thereof, scale is always removed from the surface of the workpiece by the liquid opposite to the movement direction of the workpiece, which contributes to a high efficiency of the descaling. In this regard, it is to be noted that this is because effective descaling presumes that the jet nozzles operate in a "scraping" manner, which means that the spraying direction of the jet nozzles is aligned opposing the movement direction of the workpiece. The targeted introduction of the removed scale and the liquid rebounding from the surface of the workpiece into the collection unit effectively prevents removed scale from remaining on the surface of the workpiece and being rolled back into the surface during a renewed rolling procedure. In the same manner, in this way facility components of the device according to the invention are soiled less or in the best case not at all by removed scale and/or randomly spraying liquid. Additionally, it is to be noted that the fixed attachment of the jet nozzles on the rotor head result in a substantial structural simplification of the kinematics of the rotor head, because in this way planetary gears or the like, which are otherwise provided according to the prior art for additional rotation of the jet nozzles about the longitudinal axis thereof, can be omitted.

In an advantageous refinement of the invention, the rotor head is arranged in relation to the collection unit such that the liquid is exclusively sprayed in the direction of the collection unit from the jet nozzles, with respect to a projection in a plane parallel to the surface of the workpiece. In this way, a targeted introduction of removed scale and of liquid rebounding from the surface of the workpiece after being sprayed out of the jet nozzles into the collection unit is further optimized.

In an advantageous refinement of the invention, the positioning of the rotor head in relation to the movement direction of the workpiece and the attachment of at least one jet nozzle, preferably all jet nozzles, on the rotor head are selected such that the spraying direction of at least the one jet nozzle, preferably all jet nozzles, in which the liquid is sprayed onto the workpiece, extends permanently and opposing the movement direction of the workpiece, specifically in relation to a projection of this spraying direction in a plane parallel to the surface of the workpiece. This has the result that the spraying angle between the spraying direction and the movement direction of the workpiece, in a plane parallel to the surface of the workpiece, is in a range between 170° and 190°, and preferably assumes the value of 180°. This advantageously results, in the same manner as the above-mentioned arrangement of the rotor head in relation to the collection unit, in a targeted introduction of the removed scale and the liquid rebounding from the surface of the workpiece into the collection unit, because the spraying direction of the jet nozzles does not contain any component or fraction which is oriented in the direction of a side edge of the workpiece.

An optimum energy introduction is achieved for the liquid sprayed at high pressure onto the surface of the workpiece in that a plurality of jet nozzles are attached on the rotor head each at a radial distance of a different amount from its axis of rotation, wherein a greater volume flow of liquid is also dispensed from a jet nozzle which has a greater radial distance to the axis of rotation than in comparison to a jet nozzle which has a smaller radial distance to the axis of rotation. This can be achieved in a simple manner by selection of a suitable nozzle type, and therefore accordingly a greater quantity of liquid, i.e., a greater volume flow is sprayed out of a jet nozzle which is arranged radially farther away from the axis of rotation of the rotor head. Accordingly, the energy introduction for the liquid transverse to the movement direction of the workpiece, i.e., over its width, is optimized by such a design of a majority of jet nozzles on the rotor head.

In an advantageous refinement of the invention, the rotor head is arranged inclined such that its axis of rotation is inclined diagonally at an angle with respect to an orthogonal on the surface of the workpiece. In this case, the jet nozzles are each attached fixedly on the rotor head, and therefore the angle of attack which the liquid sprayed out of the jet nozzles encloses with an orthogonal on the surface of the workpiece remains constant. The jet nozzles are preferably attached on the rotor head such that the longitudinal axes thereof extend parallel to the axis of rotation of the rotor head.

In an advantageous refinement of the invention, a first rotor head arrangement and a second jet nozzle arrangement can be provided, which are arranged in succession in relation to the movement direction of the workpiece and in particular adjoining one another.

A rotor head arrangement in the present invention is either a rotor head pair, in which one rotor head is provided in each case above and below a workpiece, i.e., on its upper side and lower side, or a rotor module pair, in which—above and below the workpiece—in each case a plurality of rotor heads are combined adjacent to one another and transversely to the movement direction of the workpiece. In a normal mode, it can be provided that liquid is sprayed onto the workpiece only from the jet nozzles of the first rotor head arrangement. In a special mode, the jet nozzles of the second jet nozzle arrangement can be switched on, and therefore liquid is also dispensed or sprayed onto the workpiece from the jet nozzles of the second jet nozzle arrangement. For this case, the jet nozzles of both the first rotor head arrangement and also the second rotor head arrangement are used to descale the workpiece. The jet nozzle arrangement of the second arrangement can differ structurally from the first rotor head arrangement. The use of both arrangements in the special mode is recommended, for example, for types of steel which are difficult to descale, or in the case of stubborn scale residues, which can arise, for example, due to contact on furnace rollers. In such an embodiment, according to which only the jet nozzles of the first rotor head arrangement are used in the normal mode, the operating medium consumption can advantageously be minimized. This applies similarly for the case in which a plurality of rotor heads—as explained—are combined to form a rotor head module. This is because in this case, only one rotor module pair is used in normal operation, wherein a further jet nozzle arrangement, which is arranged downstream in the movement direction of the workpiece, for example, is switched on as needed.

Further advantages of the invention are that the individual rotors of a rotor module may be depressurized individually and/or in groups and thus the discharge of the liquid transverse to the movement direction can be adapted to the width of the workpiece.

In one advantageous refinement of the invention, a scale detection unit having a signaling connection to a control unit can be provided, which is arranged downstream from the rotor head in relation to the movement direction of the workpiece and close to the rotor head, in order to be able to detect remaining scale on the surface of the workpiece. On the basis of the signals of this scale detection unit, the descaling quality of the workpiece is compared by means of the control unit to a predetermined target setting and then a high-pressure pump unit, which has a fluid connection to the jet nozzles of the rotor head, is suitably controlled or regulated in dependence thereon.

The actuation of the high-pressure pump unit can take place in such a manner that a pressure with which liquid is sprayed out of the jet nozzles onto the surface of the workpiece is set in dependence on the signals of the scale detection unit. This means that the pressure for the liquid to be sprayed out is set just high enough that a sufficient descaling quality is still achieved for the workpiece. If—viewed in the movement direction of the workpiece—at least two jet nozzle arrangements are arranged in succession, by way of said actuation, a jet nozzle arrangement which can be switched on will be switched on suitably in dependence on the signals of the scale detection unit, which corresponds to the mentioned special mode according to the invention. In comparison to a typical two-row arrangement of rotor heads or spray bars, a substantial savings in operating media is achieved by such a one-row arrangement, i.e., a single rotor head arrangement which is used in normal operation.

Due to the above-mentioned adaptation of the pressure, i.e., due to a reduction of the pressure, a reduced abrasion effect of the liquid on all surrounding materials or facility parts also results, whereby both the maintenance costs decrease and also wear of the jet nozzles themselves is reduced.

The quantity of water required for clean descaling of the workpiece can be suitably minimized by a variation of the pressure and/or the volume flow by way of the installation of a scale detection unit and the incorporation thereof into a control or regulating unit. This results in a savings of energy for the provision of high-pressure water, and also in the same manner in reduced cooling of the workpiece as a result of a reduced quantity of liquid which is sprayed onto the workpiece.

In addition, it is to be noted that a distance of the rotor head to the surface of the workpiece can be adjusted. An adaptation to different batches of workpieces having different heights is thus possible. In addition, it is also possible to set this distance of the rotor head to the surface of the workpiece in dependence on the signals of the scale detection unit. For example, in this manner, in the event of inadequate descaling quality, the distance of the rotor head to the surface of the workpiece can be reduced, and therefore a greater impact pressure in relation to the liquid sprayed thereon thus results at the surface of the workpiece. Mutatis mutandis, this also applies in reverse, according to which the distance of the rotor head to the surface of the workpiece, if the descaling quality exceeds the predetermined target value, can be at least slightly increased.

Further advantages of the invention are that it is possible by way of the collection of the scale detached from the surface of the workpiece to reduce or even preclude scale flaws due to rolling in of scale residues which fall down in an uncontrolled manner. Accordingly, scale-free, clean surfaces are achieved for a workpiece with comparatively low water consumption, whereby energy for producing the high-pressure water is saved in a substantial amount. The comparatively lower water consumption results in an increased scale particle content of the water introduced into a collection unit. In other words, the water introduced into a collection unit has a greater degree of soiling, because of a higher solid content of detached scale particles. Due to the reduced specific quantity of water which is used for the descaling of the workpiece, the required heating energy for a furnace or the required forming energy for subsequent rolling of the workpiece can be substantially reduced. Because of the temperature savings, thinner final thicknesses can thus be produced for a workpiece or hot rolled stock, and therefore the product mix can be enlarged. In addition, the service life of furnace rollers also substantially lengthens at a lower furnace temperature.

BRIEF DESCRIPTION OF THE DRAWINGS

Exemplary embodiments of the invention are described in detail hereafter on the basis of a schematic simplified drawing.

In the figures.

Figure 1:
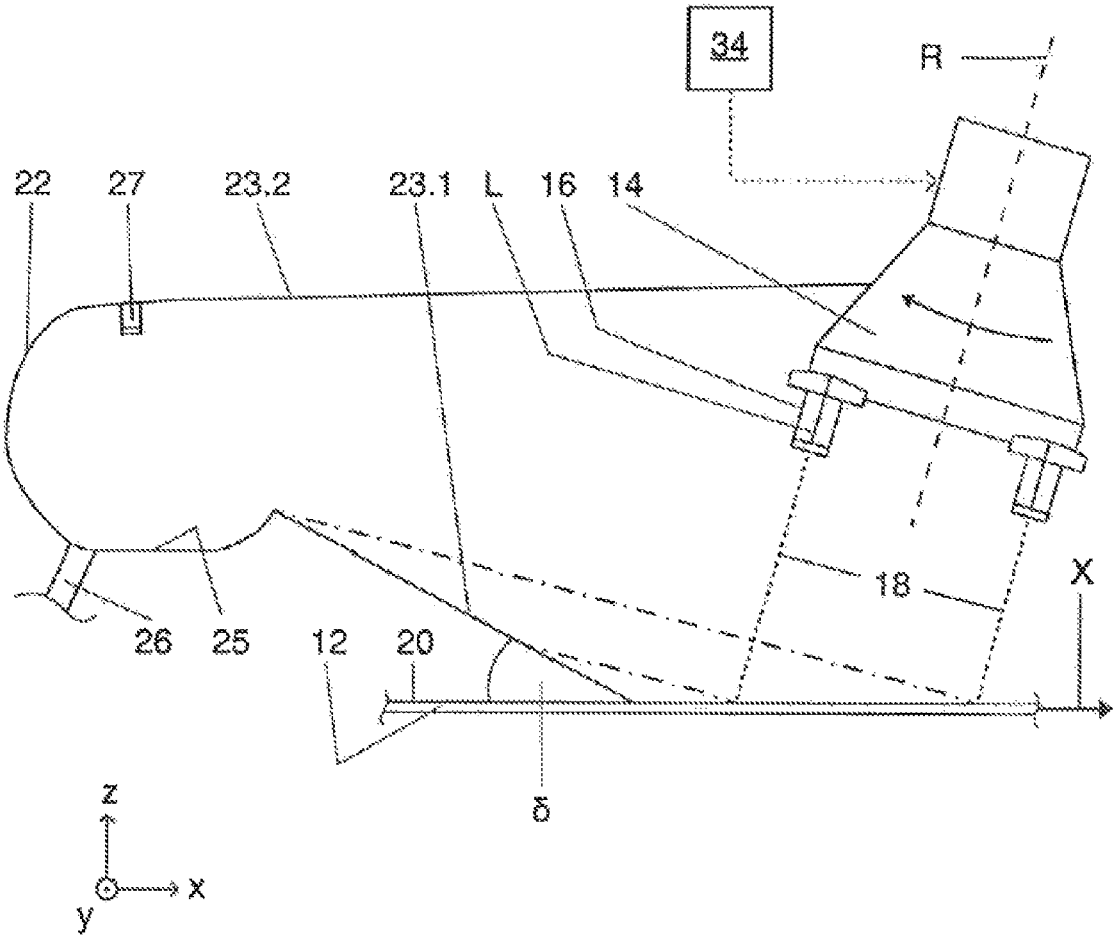
FIG. 1 shows a schematic simplified side view of a device according to the invention.

Various embodiments of the invention will be described in detail hereafter with reference to FIGS. 1 to 12. In the figures, identical technical features are each identified with identical reference signs. Furthermore, it is to be noted that the illustrations in the drawing are schematically simplified and in particular are not shown to scale. In some figures, Cartesian coordinate systems are shown, for the purpose of spatial orientation of the embodiments according to the invention in relation to a workpiece in motion to be treated.

DETAILED DESCRIPTION

A device 10 according to the invention is used for descaling a workpiece 12, which is in motion in relation to the device 10 in a movement direction X. The workpiece 12 can be a hot rolled stock, which is moved past the device 10.

In the embodiment of FIG. 1, the device 10 comprises a rotor head 14, which can be set into rotation about an axis of rotation R. A rotation of the rotor head 14 about its axis of rotation R is performed by motor means (not shown), for example, by an electric motor. Jet nozzles 16 are attached on an end face of the rotor head 14, which faces toward the workpiece 12. A liquid 18 (symbolized in simplified form by dashed lines in FIG. 1) is sprayed under high pressure onto a surface 20 of the workpiece 12 from the jet nozzles 16 in order to suitably descale the workpiece. For this purpose, the jet nozzles 16 have a fluid connection to a high-pressure pump unit (not shown), by means of which the jet nozzles are supplied with a liquid under high pressure. The liquid 18 is preferably water, without a restriction solely to water being seen therein.

In the embodiment of FIG. 1, the device 10 comprises a collection unit 22, which is arranged upstream of the rotor head 14 with respect to the movement direction X of the workpiece 12. Such a collection unit 22 is used for the purpose of receiving both scale, which has been removed from the surface 20 of the workpiece by means of the high-pressure liquid, and also the liquid, which rebounds therefrom after a contact with the surface 20 of the workpiece 12. In the illustration of FIG. 1, removed scale and the liquid rebounding from the surface 20 of the workpiece 10 are symbolized in simplified form by dot-dash lines.

In conjunction with the collection unit 22, a lower baffle plate 23.1 is provided, which is arranged between the rotor head 14 and the collection unit 22 and directly adjoins an open region of the collection unit 22 in this case. The lower baffle plate 23.1 is attached or fastened in this case on the collection unit 22 in such a way that its free end is positioned directly above the workpiece 12 and at the same time encloses an angle δ (FIG. 1) between 25-35° with the surface 20 of the workpiece. The lower baffle plate 23.1 is preferably attached in such a way that the angle δ in relation to the surface 20 of the workpiece 12 assumes a value of 30°.

The lower baffle plate 23.1 is arranged flatly rising in the direction of the collection unit 22 in accordance with the angle δ of preferably 30°. The lower baffle plate 23.1 therefore fulfills the task of a deflector plate and causes a targeted introduction of the scale and the liquid rebounding from the surface 20 into the collection unit 22.

In addition, a cover unit in the form of an upper cover plate 23.2 is provided, which extends from the collection unit 22 up to directly at the rotor head 14 and assumes the function of a cover in this case. The distance of an edge of the upper cover plate 23.2, which directly adjoins the rotor head 14, is selected in this case such that the section between the edge of the upper cover plate 23.2 and the rotor head 14 is passage-free with respect to scale particles. In the meaning of the present invention, "passage-free" means that scale particles, when they have been detached from the surface 20 of the workpiece 12 as a result of the sprayed water, cannot escape between the edge of the upper cover plate 23.2 directly adjoining the rotor head 14 and the rotor head 14. Accordingly, the upper cover plate 23.2 prevents scale or liquid rebounding from the surface 20 of the workpiece 12 from escaping upward to the surroundings. Nonetheless, it is ensured in this case that air can pass through the section between the upper cover plate 23.2 and the rotor head 14, and therefore stagnation pressure does not form below the upper cover plate 23.2 during the operation of the device 10 according to the invention.

Figure 2:
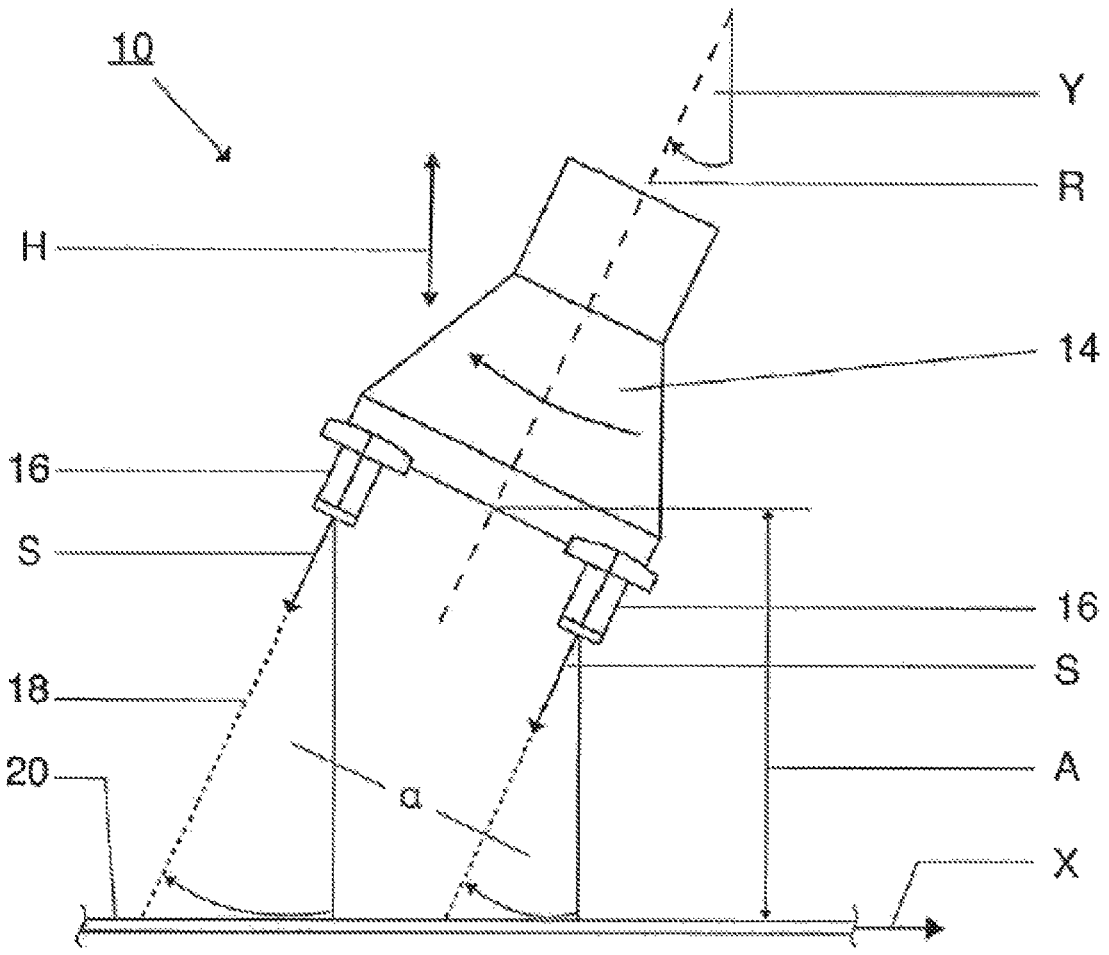
FIG. 2 shows a side view of a rotor head of the device from FIG. 1, FIG. 3*a*, FIG. 3*b*, and FIG. 3*c* each show a schematic relationship between a spraying direction of jet nozzles of a device according to FIG. 1 and a movement direction, in which a workpiece is moved past this device.

Further relationships for the arrangement of the rotor head 14 and the jet nozzles 16 attached thereon are explained hereafter with reference to FIGS. 2 and 3.

The jet nozzles 16 are fixedly attached to an end face of the rotor head 14 opposite to the workpiece 12. In this case, the longitudinal axes L of the jet nozzles 16 are aligned parallel to the axis of rotation R of the rotor head 14. Accordingly, the spraying direction S (cf. FIG. 2), in which the liquid is sprayed out of the jet nozzles 16, also extends parallel to the axis of rotation R of the rotor head 14.

The axis of rotation R is arranged inclined diagonally at an angle Y (FIG. 2) with respect to an orthogonal on the surface 20 of the workpiece 12. An angle of attack a (cf. FIG. 2), at which the liquid 18 sprayed out of the jet nozzles 16 is incident on the surface 20 of the workpiece, results due to the attachment of the jet nozzles 16 on the rotor head 14, in the case of which the longitudinal axis L of the jet nozzles extend parallel to the axis of rotation R, as explained. This angle of attack a corresponds to an angle between the spraying direction S of the liquid 18 and an orthogonal on the surface 20 of the workpiece 12. Because of the parallel alignment of the longitudinal axis L of the jet nozzles 16 with the axis of rotation R, the angle of attack a in the embodiment of FIG. 2 is equal to the inclination angle Y of the axis of rotation R.

The rotor head 14 is designed as vertically adjustable. This means that a distance A, which an intersection point of the axis of rotation R with the end face of the rotor head 14 has to the surface 20 of the workpiece 12 (FIG. 2) can be changed if needed. This distance A is to be understood as the spraying distance in the meaning of the present invention. If this distance A is reduced, the resulting impact pressure of the liquid 18 on the surface 20 of the workpiece 12 increases. The vertical adjustability for the rotor head 14 is symbolized in simplified form in FIG. 2 by the letter "H" and can be implemented by a vertically-adjustable mount, on which the rotor head 14 is attached. Details of an adjustment of this distance A are also explained in detail hereafter.

Figure 3A:
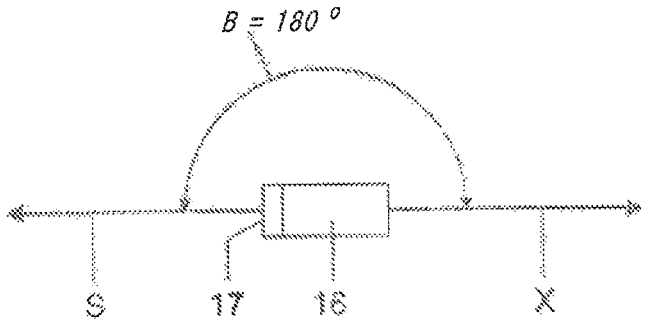

FIG. 3 illustrates a relationship between the spraying direction S, in which the liquid 18 is sprayed out of the jet nozzles 16, and the movement direction X, in which the workpiece 12 is moved past the device 10 and/or its rotor head 14. Specifically, FIG. 3 illustrates a projection of the spraying direction S in a plane parallel to the surface 20 of the workpiece 12. In the example of FIG. 3*a*, the spraying direction S, in which the liquid 18 is dispensed from a nozzle orifice 17 of a jet nozzle 16, is aligned precisely opposing the movement direction X, i.e., in a spraying angle β of exactly 180° to the movement direction X. This has the result that the spraying direction S of the liquid 18, if it is permanently sprayed under high pressure onto the workpiece 12, does not have a fraction which points in the direction of a lateral edge of the workpiece 12. It is ensured in this way that the liquid 18 is always sprayed precisely in the direction of the collection unit 22 from the jet nozzles 16 onto the surface 20 of the workpiece. As a result thereof, the removed scale is introduced in conjunction with the liquid 18 rebounding from the surface 20 of the workpiece 12 in a targeted manner into the collection unit 22.

Figure 3B:
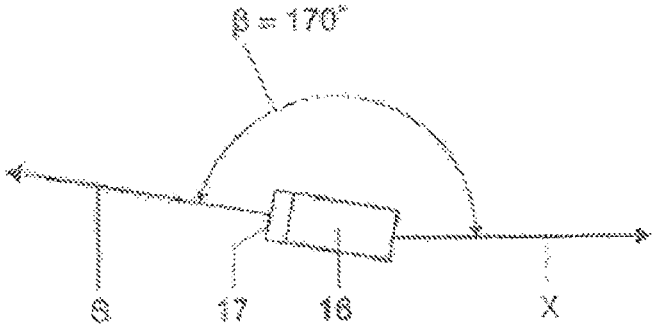
Figure 3C:
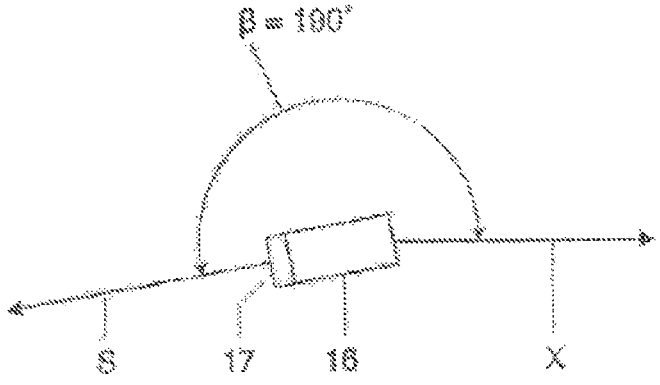

According to the examples of FIG. 3*b* and FIG. 3*c*, it is also possible that the spraying angle β is greater or less than 180°, for example, 170° or 190°, or falls in a value range between 170° and 190°. This means that the spraying direction S does not extend precisely opposing the movement direction X, but rather encloses an angle with the movement direction X which—as explained and illustrated in FIGS. 3*b* and 3*c*—can be in a range between 170° to 190°.

It is noted separately at this point that the above-explained alignment of the spraying direction S, as shown in the illustrations according to FIG. 3*a*, FIG. 3*b*, and FIG. 3*c*, remains unchanged or constant during a rotation of the rotor head 14 about its axis of rotation R. This also applies for the angle of attack a.

With respect to the rotor head 14 according to FIG. 2, it is to be noted that this rotor head 14 can correspond to that of FIG. 1. Notwithstanding this, it is also possible for the present invention to provide the rotor head 14 according to FIG. 2 without a collection unit 22.

Figure 4:
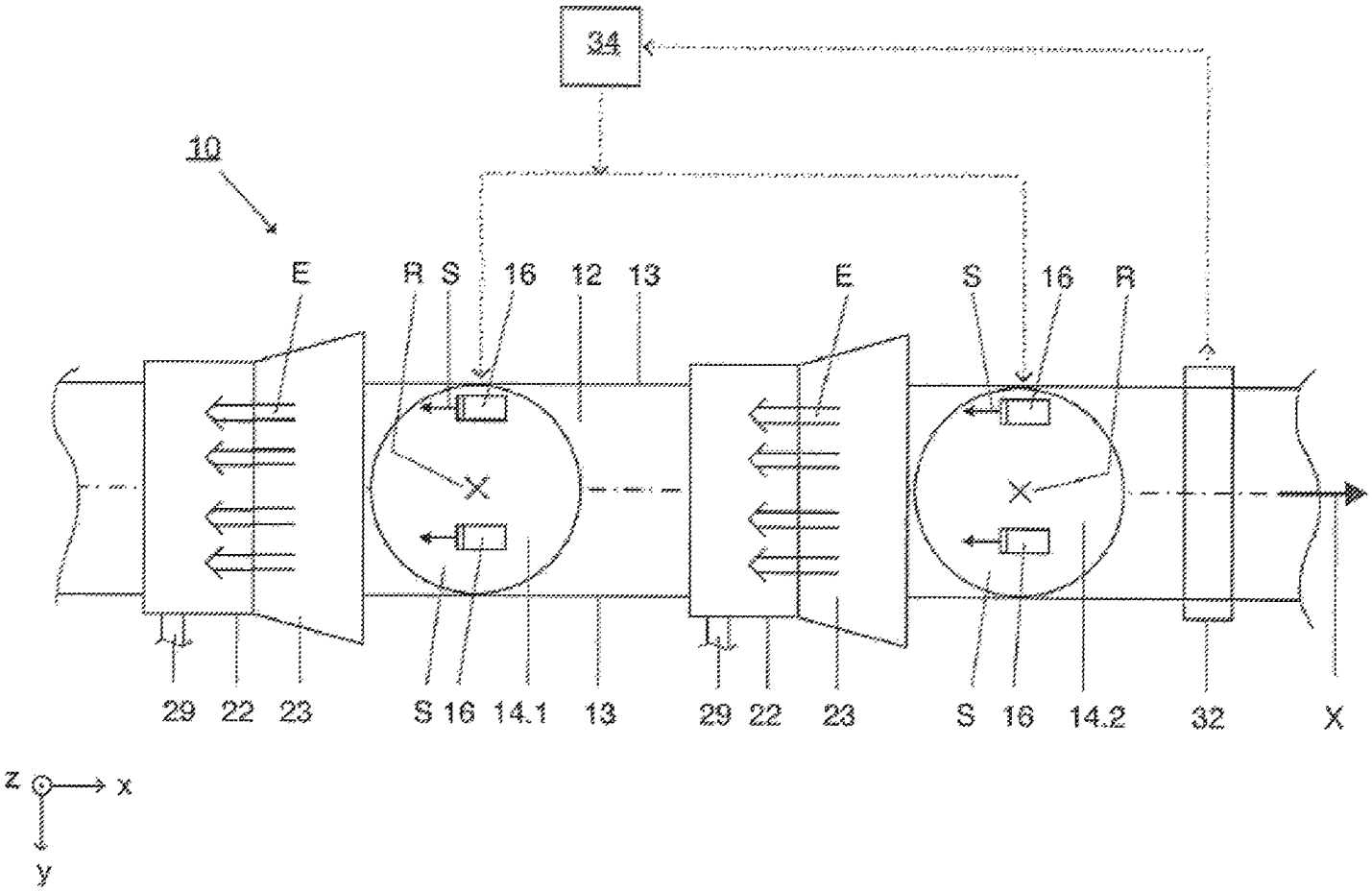
FIG. 4 shows a schematic simplified top view of a device according to the invention according to a further embodiment.

A further embodiment of a device 10 according to the invention is shown in FIG. 4, specifically in a schematic, very simplified top view. In this case, two rotor heads 14.1 and 14.2 are arranged in succession with respect to the movement direction X of the workpiece 12. A separate collection unit 22, which is arranged upstream of an associated rotor head with respect to the movement direction X of the workpiece 12, is associated with each of these rotor heads 14.1 and 14.2. In principle, instead of the rotor head 14.2, another jet nozzle construction can also be provided.

The top view of FIG. 4 illustrates once again that the spraying direction S, in which the liquid 18 is dispensed from the jet nozzles 16 attached to a rotor head 14, does not have a fraction which points in the direction of a lateral edge 13 of the workpiece 12, but rather is instead oriented directly onto an associated collection unit 22.

Because of the reduced applied quantity of water according to the invention with improved effectiveness at the same time, the degree of soiling of the water with scale residues and/or corresponding solid particles is elevated, and therefore a different design of the collection unit is recommended.

The introduction of removed scale and liquid rebounding after a contact with the workpiece 12 from its surface 20 into a respective collection unit 22 is assisted as explained above by the lower baffle plate 23.1 rising flatly at the angle δ and is symbolized in FIG. 4 by the arrows "E".

Figure 5:
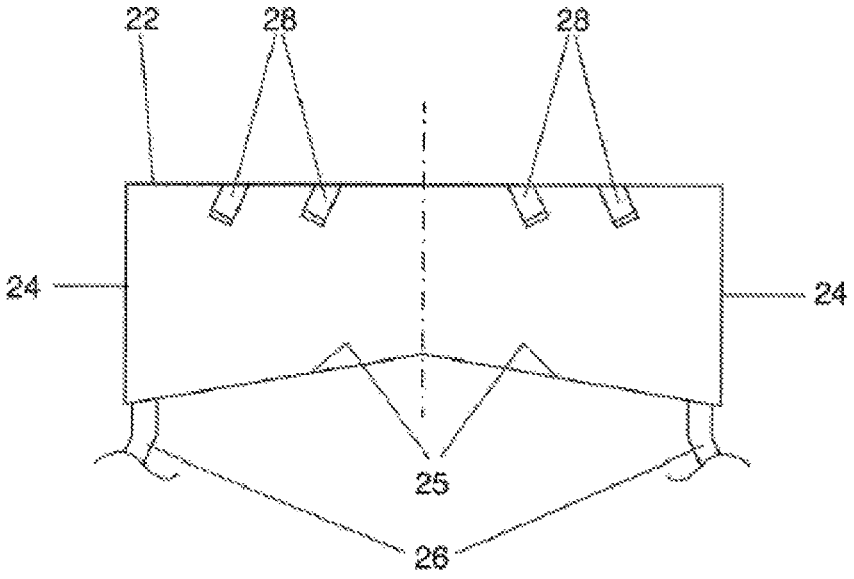
FIG. 5 shows a simplified cross-sectional view of a collection unit of the device from FIG. 4.

Further details of the collection unit 22 result from FIG. 5, which shows a cross-sectional view thereof.

A bottom surface 25 of the collection unit 22 is formed inclined laterally downward in each case. In the illustration of FIG. 5, the vertical symmetry line is aligned with a center of the workpiece 12. This has the result that the bottom surface 25 of the collection unit 22, starting from its center, drops down toward the lateral edges 24, and thus scale and liquid which are introduced into the collection unit 22 are also moved in the direction of the lateral edges 24.

The collection unit 22 is connected to a drainpipe 26, for example, at both lateral edges 24. Cleaning liquid and removed scale are discharged from the collection unit 22 through the drainpipe 26 as a result of gravity, for example, into a conveyor trough (not shown), into which the drainpipe 26 opens.

The discharge of cleaning liquid and scale from the collection unit 22, specifically through the drainpipe 26, can be optimized by a conveyor unit 27, by means of which the cleaning liquid and scale inside the collection unit are conveyed in the direction of an opening of the drainpipe 26 and/or in the direction of the lateral edges 24. For this purpose, the conveyor unit 27 comprises, for example, flushing nozzles 28 (FIG. 5), from which a fluid, for example, a liquid or a gas or a mixture thereof, is discharged diagonally to the bottom surface 25. Alternatively or additionally to such flushing nozzles 28, it is also possible that the conveyor unit 27 has mechanical components, for example, scraper elements, conveyor screws, or the like, by means of which the liquid and/or the scale are conveyed in a targeted manner in the direction of an opening of the drainpipe 26.

Figure 6:
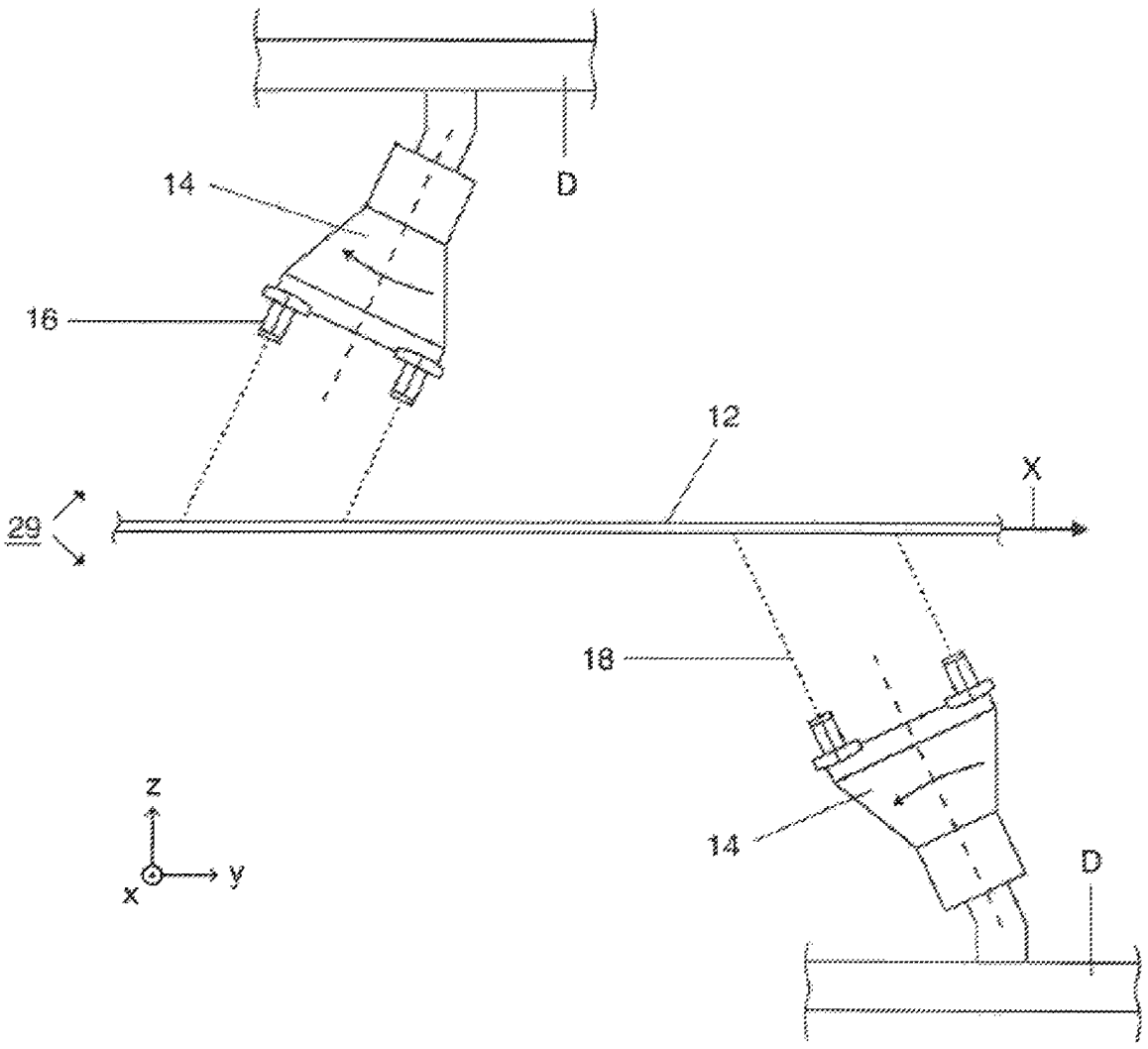
FIG. 6 shows a simplified side view of a rotor head pair, in which rotor heads according to FIG. 2 are arranged in each case on an upper side and on a lower side of a workpiece to be descaled.
Figure 7:
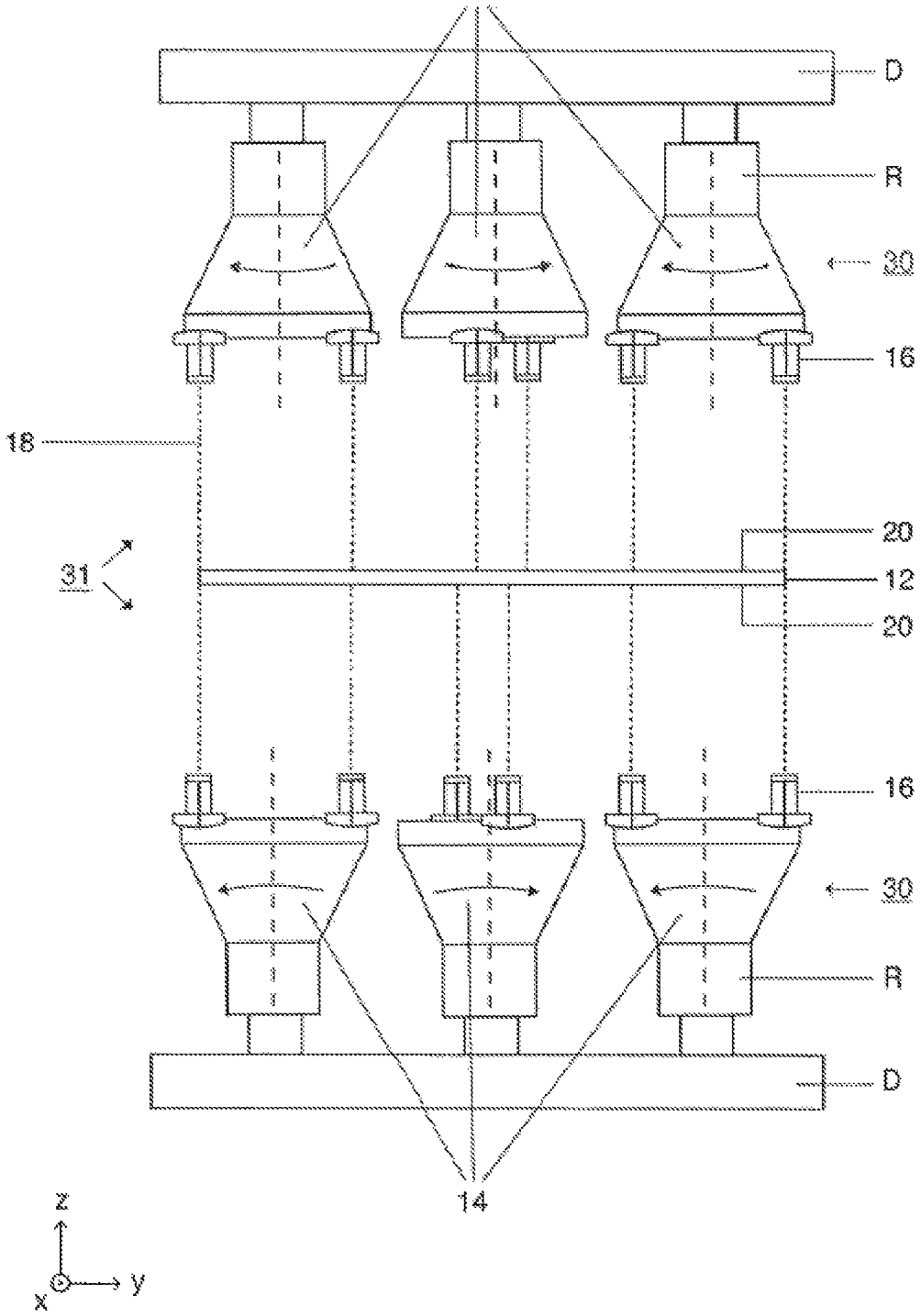
FIG. 7 shows a simplified frontal view of a rotor module, in which a plurality of rotor heads are arranged adjacent to one another and transversely to the movement direction of the workpiece.

Possible embodiments of rotor heads, which can be used, for example, in the embodiment of FIG. 4, are shown and explained hereafter with reference to FIGS. 6 and 7.

FIG. 6 shows a side view of a rotor head pair 29, in which one rotor head 14 is provided in each case above and below the workpiece 12, i.e., both on its upper side and on its lower side. It can be seen that the rotor head 14 which is arranged below the workpiece 12 is positioned upstream with respect to the movement direction X of the workpiece 12 from the rotor head 14 which is arranged above the workpiece 12. This is because liquid 18 which is sprayed from the jet nozzles 16 of the rotor head 14 arranged below the workpiece 12 thus does not, for example, strike against the rotor head 14 arranged above the workpiece 12 if no workpiece or strip material should be located between these two rotor heads. The offset shown in FIG. 6 between the rotor heads arranged above and below the workpiece 12 does not change the fact that these two rotor heads are to be understood as a rotor head pair 29 in the meaning of the present invention. In this regard, it is apparent that the reference signs 14.1 and 14.2 shown in FIG. 4 can respectively also be such a rotor head pair.

FIG. 7 shows a frontal view of rotor head modules 30, which are provided in each case above and below the workpiece 12 and thus form a rotor module pair 31. Specifically, the respective rotor head modules 30 consist of a plurality of rotor heads 14, which are arranged adjacent to one another and transversely to the movement direction X of the workpiece. Notwithstanding the illustration in FIG. 7, fewer or more than three rotor heads 14 can also be combined to form a rotor module 30.

For the illustration of FIG. 6, it is additionally to be noted that this can also be a side view of a rotor module pair 31 according to FIG. 7, wherein in each case only the rotor head 14 lying in front in the plane of the paper can be seen at the upper and lower sides of the workpiece.

With respect to the embodiments according to FIGS. 6 and 7, it is to be noted that the individual rotor heads 14 are connected to a common pressurized water line D, wherein the pressurized water line D is connected to the high-pressure pump unit. A supply of the jet nozzles 16 attached to the rotor heads with high-pressure water is ensured in this way.

In the embodiment according to FIG. 4, notwithstanding the illustration shown, it can also be provided that instead of the individual rotor heads 14.1 and 14.2, which are arranged in succession with respect to the movement direction X, rotor modules 30 are also provided, specifically—because of the arrangement above and below the workpiece 12—in the form of rotor module pairs 31 according to FIG. 7.

In the case of a rotor module 30 according to the embodiment of FIG. 7, the width of a workpiece 12, i.e., in a direction transverse to its movement direction X, is covered as shown by a plurality of rotor heads 14. In other words, the width of such a rotor module 30 substantially corresponds to a width of the workpiece 12. This results in the advantage that in contrast to, for example, only a single rotor head, the diameter of which corresponds to the width of the workpiece 12, the diameter of the individual rotor heads of a rotor module 3 can be smaller in each case, linked to the advantage that higher speeds are settable for these rotor heads, possibly also to adapt to high rolling velocities and/or high feed velocities for the workpiece.

It is advantageous if the individual rotors of a rotor module can be depressurized individually and/or in groups and thus the dispensing of the liquid is adapted to the width of the workpiece.

Figure 8:
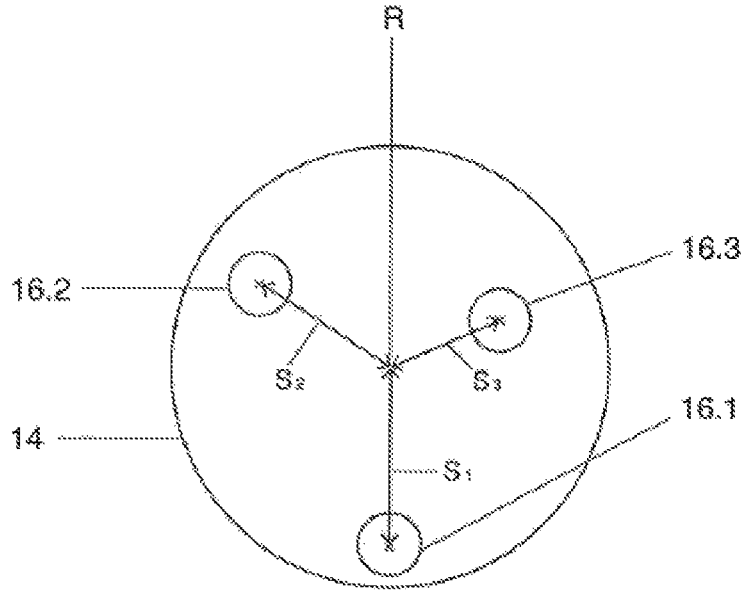
FIG. 8 shows a possible arrangement of jet nozzles on a rotor head for use in a device according to FIG. 1 or according to FIG. 4, FIGS. 9*a*, 9*b* each show spray pictures which form on the surface of a workpiece with liquid sprayed on the workpiece.
Figure 10:
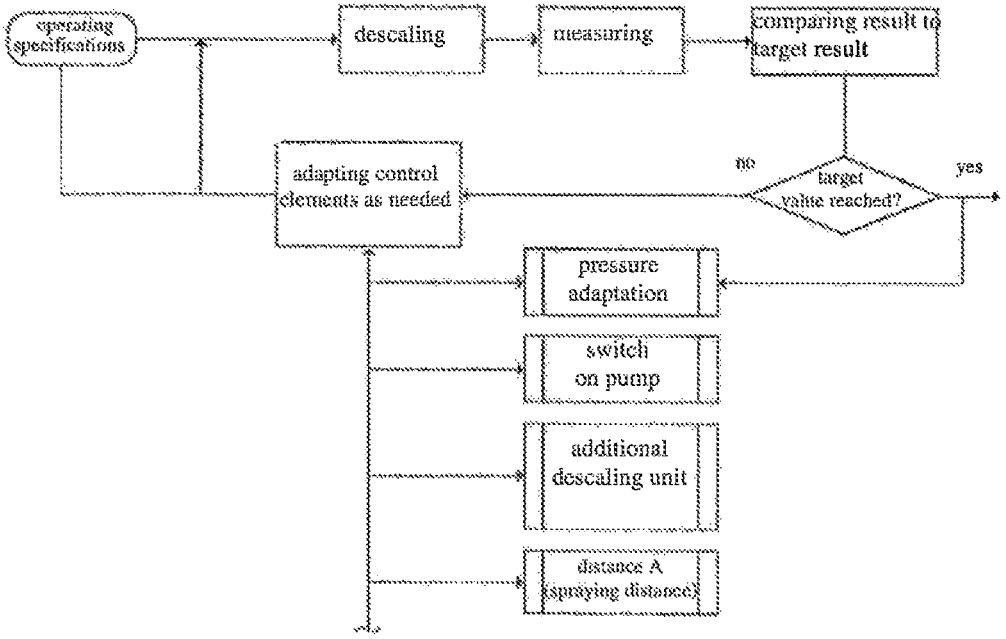
FIG. 10 shows a flow chart according to which the invention is used in practice, FIGS. 11, 12 each show side views of a rotor head according to further embodiments of the invention.

FIG. 8 symbolizes an attachment of multiple jet nozzles 16 to an end face of a rotor head 14. In the example of FIG. 8, three jet nozzles 16.1, 16.2, and 16.3 are provided, which each have a different distance s to the axis of rotation R of the rotor head 14. In the illustration of FIG. 8, the axes of rotation R extends perpendicularly to the plane of the drawing.

The different distances of the respective jet nozzles 16.1, 16.2, and 16.3 are respectively identified in FIG. 8 with s1, s2, and s3, with the proviso: s1>s2>s3. With such an arrangement of jet nozzles each having different radial distance from the axis of rotation R, it is provided that a greater volume flow of liquid is sprayed out of a jet nozzle which has a greater radial distance to the axis of rotation R than in comparison to a jet nozzle which has a smaller distance to the axis of rotation. The relationship: $\dot{V}_1>\dot{V}_2>\dot{V}_3$ then applies for the volume flow dispensed from these nozzles with respect to the three nozzles 16.1, 16.2, and 16.3 according to FIG. 8. In this way, a more uniform energy introduction onto the surface 20 of the workpiece 12 transversely to its movement direction X is achieved for the liquid dispensed from the jet nozzles 16.1, 16.2, and 16.3.

The relationships just explained with reference to the illustration of FIG. 8 are also understood for a number of jet nozzles of greater or less than three, specifically in any case for multiple jet nozzles which each have a different distance to the axis of rotation R of the rotor head 14. Furthermore, it is to be noted that the example of FIG. 8 also applies for all rotor heads 14 which are shown and explained in FIGS. 1-7.

A scale detection unit 32 can be provided for the invention, which is arranged downstream from a rotor head 14 or a rotor head pair 29 or a rotor module pair, respectively, with respect to the movement direction X of the workpiece 12, wherein reference is made hereafter to a rotor head 14 for simplification, without a restriction being seen therein. In the embodiment of FIG. 4, such a scale detection unit 32 is arranged downstream of the rotor head 14.2. Notwithstanding the number of rotor heads which can be arranged in succession in relation to the movement direction X of the workpiece 12 in the present invention, it is significant for the scale detection unit 32 that it is arranged in the spatial vicinity and downstream of a rotor head (for example, rotor head 14.2 according to FIG. 4) of the device 10, in any case before the workpiece 12 is subjected, for example, to a further rolling procedure.

The scale detection unit 32 is connected for signaling to a control unit 34 (FIG. 1, FIG. 4). It is possible by means of the scale detection unit 32 to reliably recognize and/or detect residual scale possibly remaining on the surface 20 of the workpiece 12, after the liquid 18 has been sprayed on the workpiece 12. For this purpose, the scale detection unit 32 extends completely over a width of the workpiece 12. Furthermore, it is to be noted that a scale detection unit 32 can be provided above and below the workpiece 12, i.e., on its upper side and on its lower side. It is accordingly possible by means of the scale detection unit 32 to detect possible residual scale on both surfaces of the workpiece 12.

The illustrations of FIG. 1 and FIG. 4 symbolically show that a rotor head 14 is also connected for signaling to the control unit 34. This means that it is possible by means of the control unit 34 to change the pressure with which the liquid sprayed out of the jet nozzles 16 strikes on a surface 20 of the workpiece 20 in a suitable manner. Such a change of the impact pressure of the liquid can be performed, for example, by switching on or off a pump of the high-pressure pump unit, to which the pressurized water line D for the jet nozzles 16 is connected. Additionally or alternatively, it can be provided that the high-pressure pump unit, using which the pressure supply for the jet nozzles 16 is ensured, is equipped with a frequency controller, to achieve still better adaptation of the desired pressure for the jet nozzles 16.

Alternatively and notwithstanding the provision of a scale detection unit 32, it is possible for the present invention that a rotor head 14 is connected for signaling to the control unit 34. The speed with which the rotor head 14 is rotated about its axis of rotation R can accordingly also be adapted by means of the control unit 34, for example, in dependence on the feed velocity at which the workpiece is moved past the device 10 in its movement direction X, for example. By means of such an adaptation of the speed for the rotor head 14, in particular to the feed velocity of the workpiece 12 in its movement direction X, an optimum energy introduction for the liquid 18 sprayed onto the surface 20 of the workpiece 12 is achieved, specifically along the movement direction X. Such an optimum adaptation of the speed of the rotor head 14 to the feed velocity of the workpiece 12 is shown in the spraying picture according to FIG. 9*a*, which shows a portion of a surface 20 of the workpiece 12 in a top view. In contrast, the illustration of FIG. 9*b* illustrates a nonoptimal adaptation of the speed of the rotor head 14 to the feed velocity of the workpiece 12. It is possible by means of the invention to avoid a spray picture according to the illustration of FIG. 9*b*.

The invention functions as follows:

For a desired descaling of the surfaces 20 of a workpiece 12, this workpiece is in motion in relation to the device 10 according to the invention in a movement direction X. For this purpose, rotor heads 14 of the device 10 are preferably provided both on a top side and also on a bottom side of the workpiece 12, according to the embodiment of FIG. 6. A descaling of the workpiece 12 is achieved in that a liquid 18 is sprayed from the jet nozzles 16 attached to a rotor head 14 under high pressure onto the surfaces 20 of the workpiece 12. As a result of the above-explained alignment of the jet nozzles 16 and the spraying direction S for the liquid 18 resulting therefrom, removed scale, in conjunction with the liquid rebounding from the surface 20 of the workpiece 12, is introduced in a targeted manner into the collection unit 22.

Means (not shown) are provided, by way of which the control unit 34 receives an item of information with respect to the feed velocity of the workpiece 12 in its movement direction X. Based thereon, a desired speed for a rotor head 14 can be set by means of the control unit 34, specifically in adaptation to the feed velocity of the workpiece 12. Such an adaptation is also possible in the running production mode, if variations occur in the feed velocity for the workpiece 12. The control unit 34 can be configured by programming in such a way that such an adaptation of the speed of a rotor head 14 also takes place in a regulated manner.

On the basis of the signals of the scale detection unit 32, the pressure with which the jet nozzles 16 attached to a rotor head 14 are supplied with the liquid 18 can be set and/or adapted to a predetermined value. This means that the pressure of the liquid 18 provided for the jet nozzles 16 is set just high enough, for example, that a sufficient descaling quality is achieved, which can then be monitored by means of the scale detection unit 32. In this way, a savings of the quantity of water and energy is possible. In contrast, if it should be recognized by the control unit 34, on the basis of the signals generated by the scale detection unit 32, that the descaling quality falls below a defined setpoint value, this can be compensated for by a suitable pressure increase, by switching on a pump and/or by switching on an additional descaling unit, for example, in the form of a rotor head pair 29 or a rotor module pair 31. Such an operating sequence according to the present invention is also illustrated in the flow chart of FIG. 11.

Additionally and/or alternatively, the change of the impact pressure can be performed by a vertical adjustment of the rotor head arrangement. This vertical adjustment is symbolized in FIG. 2, as already explained therein, by the arrow "H". In this case, the distance A (FIG. 2), which a rotor head 14 has from the surface 20 of the workpiece 12, can be adjusted and/or changed in dependence on the signal values of the scale detection unit 32. For example, this distance A can be reduced if the descaling quality of the surface 20 of the workpiece 12 is judged to be unsatisfactory, wherein the impact pressure of the liquid 18 on the surface 20 of the workpiece 12 increases as a result of the reduced distance A. Conversely, this means that the distance A can also be increased, in any case as long as the descaling quality remains sufficiently high and a predetermined setpoint value for this purpose is achieved.

To carry out the present invention, it is advisable in the production of the device 10 according to the invention to select the inclination of the rotor head (cf. angle γ in FIG. 2) and the attachment of the jet nozzles 16 to the rotor head such that the angle of attack a is in a range from 5° to 25° and preferably assumes a value of 15°.

Figure 11:
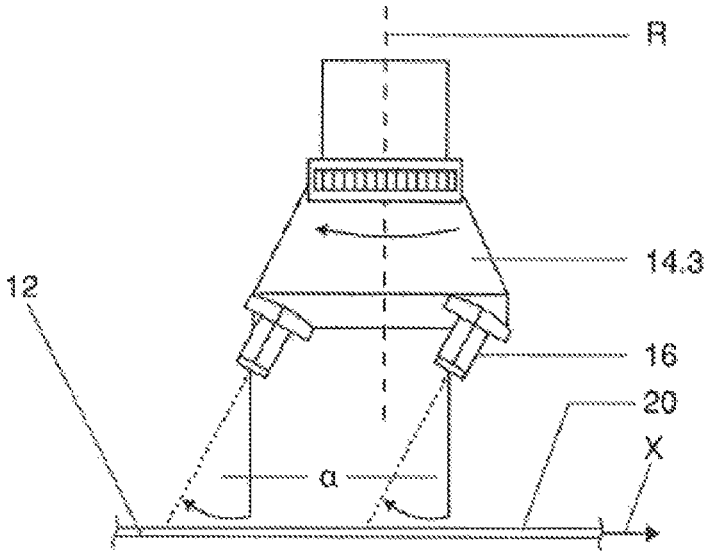
Figure 12:
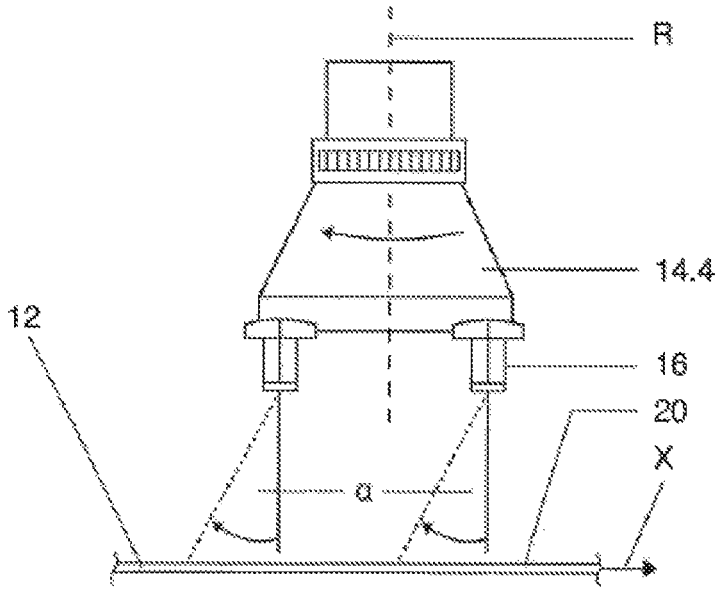

Finally, it is to be noted that a rotor head 14.3 according to the illustration of FIG. 11 and/or a rotor head 14.4 according to the illustration in FIG. 12 can also be used for the present invention.

In the rotor head 14.3 according to FIG. 11, its axis of rotation R extends perpendicularly to the surface 20 of the workpiece 12 to be descaled, wherein the jet nozzles 16 are attached inclined on an end face of the rotor head 14.3. During a rotation of the rotor head 14.3 about its axis of rotation R, the jet nozzles 16 are rotated simultaneously and synchronously about the longitudinal axis L thereof such that at the same time the angle of attack a in relation to the surface 20 remains constant in each case. This is achieved via a planetary gear 36, which is integrated into the rotor head 14.3.

Figure 13:
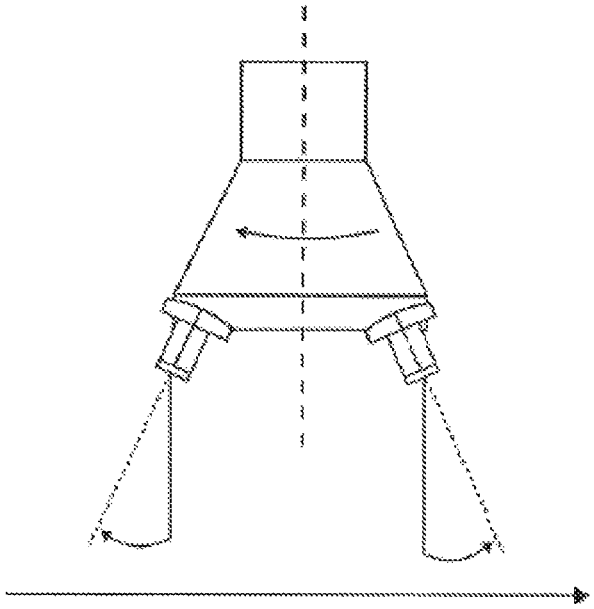
Prior art Fig. 13
FIG. 13 is a view of a prior art nozzle head having outwardly inclined nozzles.

In the rotor head 14.4 according to FIG. 12, the axis of rotation R also extends perpendicularly to the surface 20 of the workpiece 12, wherein the jet nozzles 16 are attached to the rotor head 14.4 with the longitudinal axis L thereof parallel to the axis of rotation R. The jet nozzles 16 have a suitably formed outlet opening at the respective nozzle orifice 17 thereof, by which a deflection of the sprayed liquid 18 is achieved, whereby the angle of attack a shown in FIG. 13 results. This angle of attack a thus remains constant during a rotation of the rotor head 14.4 about its axis of rotation, by the jet nozzles 16 each being rotated about the longitudinal axis L thereof by means of a planetary gear synchronously to the rotation of the rotor head 14.4.

It is apparent that the rotor heads 14.3 and/or 14.4 can also be used like a rotor head pair 29 and/or like a rotor module pair 31 according to the illustrations in FIG. 6 and in FIG. 7, respectively.

If the rotor heads 14.3 and 14.4 are used, the same spraying direction S can be achieved for the sprayed liquid 18 as shown in the illustration of FIG. 3*a*. Alternatively thereto, it is also possible if a rotor head 14.3 or 14.4 is used to set a spraying direction S for at least one jet nozzle attached to such a rotor head, such that the resulting spraying direction S encloses an angle with the movement direction X of 170° (FIG. 3*b*) or 190° (FIG. 3*c*), or an angle which respectively lies between 170°-180° or 180°-190°.

It is possible, for example, that the rotor head shown in FIG. 8 is a rotor head according to FIG. 11 or FIG. 12. In this case, it can then be provided that the spraying direction S of the jet nozzle 16.2 is aligned at a spraying angle β of 180° (FIG. 3*a*), wherein the spraying direction S of the jet nozzle 16.1 is aligned at a spraying angle β of 170° (FIG. 3*b*) and the spraying direction S of the jet nozzle 16.3 is aligned at a spraying angle β of 190° (FIG. 3*c*). By way of such an arrangement of jet nozzles on a rotor head, it is possible to further enhance the descaling quality for the workpiece 12, because possible depressions which can form on the surface 20 of the workpiece hereby also experience effective descaling by avoiding spray shadows.

Moreover, it is to be noted that the rotor heads 14.3 and 14.4 according to FIG. 11 and FIG. 12, respectively, can be used in the same manner as the rotor head 14 (FIG. 2) in the embodiments according to FIG. 1 or FIG. 4. The mode of operation for descaling the workpiece 12 remains unchanged in this case, and therefore reference can be made to the above explanations to avoid repetitions.

LIST OF REFERENCE DESIGNATIONS

10 device
12 workpiece
14 rotor head
16 jet nozzle
16.1 jet nozzle
16.2 jet nozzle
16.3 jet nozzle
18 liquid
20 surface
22 collection direction
23.1 cover unit
23.2 cover unit
26 drainpipe
27 conveyor unit
28 flushing nozzle
29 rotor head pair
31 rotor module pair
32 scale detection unit
α a angle of attack
β spraying angle
Y angle
L longitudinal axis
R axis of rotation
S spraying direction
$V_1$ volume flow
$V_2$ volume flow
$V_3$ volume flow
X movement direction

What is claimed is:

1. A device for descaling a moving workpiece in a movement direction in relation to the device, the device comprising:

at least one rotor head rotatable about an axis of rotation; a plurality of jet nozzles positioned at an end face of the at least one rotor head which faces towards the workpiece, the plurality of jet nozzles being configured to selectively dispense a liquid onto the workpiece at a predetermined angle of attack ($\alpha$) that is inclined with respect to an orthogonal on a surface of the workpiece, the liquid dispensed from the plurality of nozzles being at a predetermined pressure sufficient to descale particles from the workpiece;

wherein the jet nozzles are arranged and configured on the at least one rotor head such that during rotation of the at least one rotor head about its axis of rotation, a spraying direction of the liquid being dispensed from the jet nozzles, with respect to a projection in a plane parallel to the surface of the workpiece is aligned permanently opposed at a spraying angle ($\beta$) between 170° and 190°, to the movement direction of the workpiece and the angle of attack ($\alpha$) for the plurality of jet nozzles remains constant; and a collection unit arranged adjacent the workpiece and upstream from the at least one rotor head with respect to the movement direction of the workpiece, such that the pressurized liquid dispensed from the jet nozzles, after rebounding from the surface of the workpiece and the particles removed by the pressurized liquid from the surface of the workpiece are collected by the collection unit.

2. The device of claim 1, wherein a first of the plurality of jet nozzles on the at least one rotor head is spaced apart a greater radial distance ($s_1$; $s_2$; $s_3$) with respect to the axis of rotation than a second of the plurality of jet nozzles, wherein the first jet nozzle is configured to dispense a greater volume flow ($\dot{V}_1$; $\dot{V}_2$; $\dot{V}_3$) of liquid than the second jet nozzle which has a smaller radial distance to the axis of rotation.

3. The device of claim 1, wherein the at least one rotor head is arranged in relation to the collection unit such that the liquid is dispensed from the plurality of jet nozzles exclusively in a direction of the collection unit.

4. The device of claim 1, wherein the at least one rotor head is arranged adjacent to and in relation to the movement direction of the workpiece and an angle of at least one jet nozzle of the plurality of jet nozzles is arranged such that the spraying direction in which the liquid is dispensed from the at least one jet nozzle extends precisely opposing the movement direction, wherein the projection in a plane parallel to the surface of the workpiece defining the spraying angle ($\beta$) between the spraying direction and the movement direction is precisely 180°.

5. The device of claim 1, wherein at least one drainpipe is attached to the collection unit and configured to discharge the liquid dispensed from the plurality of jet nozzles and removed scale particles from the collection unit.

6. The device of claim 5 further comprising a conveyor unit by which the removed scale is transportable inside the collection unit in the direction of an opening of the drainpipe.

7. The device of claim 6, wherein the conveyor unit has at least one flushing nozzle from which a cleaning fluid is dispensed.

8. The device of claim 1, wherein the at least one rotor head comprises a plurality of rotor heads defining a rotor module, wherein each of the plurality of rotor heads are selectively depressurized individually and/or in groups to adapt the dispensing of the liquid transversely to the movement direction of the workpiece.

9. The device of claim 1, wherein a cover unit is arranged between the collection unit and the at least one rotor head, the cover unit being configured to extend from the collection unit to at the at least one rotor head such that a gap formed between the at least one rotor head and an edge of the cover unit is sized and configured to prevent passage of particles therethough.

10. The device of claim 1, wherein the at least one rotor head is inclined with the axis of rotation with respect to an orthogonal on a surface of the workpiece diagonally at an angle (Y), wherein each of the plurality of jet nozzles have a longitudinal axis and each jet nozzle is fixedly attached on the at least one rotor head such that, the longitudinal axes (L) of each jet nozzle is parallel to the axis of rotation of the at least one motor head.

11. The device of claim 1, wherein the at least on rotor head comprises a first rotor head and a second rotor head spaced apart from the first rotor head, the first and second rotor heads being arranged in succession with respect to the movement direction of the workpiece.

12. The device of claim 11, wherein at least one of the first rotor head and second rotor head is configured to dispense the pressurized liquid to descale the workpiece.

13. The device of claim 1, further comprising a scale detection unit arranged downstream of the at least one rotor head with respect to the movement direction of the workpiece, and a control unit in electronic communication with the scale detection unit and the at least one rotor head, wherein remaining scale on the surface of the workpiece is detected by the scale detection unit, wherein the control unit is configured to determine a descaling quality of the workpiece based on a comparison of remaining scales detected on the workpiece by the scale detection unit and a predetermined target value; and a pump in fluid connection to the plurality of jet nozzles of the at least one rotor head, the pump controlling the pressurized liquid dispensed by the plurality of jet nozzles based on the descaling quality of the workpiece.

14. The device of claim 13, wherein the plurality jet nozzles of the at least one rotor head are selectively switched on by the control unit based on the signals received from the scale detection unit.

15. The device of claim 13, wherein the scale detection unit controls the pump to set the pressure at which the liquid is sprayed out of the plurality of jet nozzles.

16. The device of claim 13, wherein a distance of the at least one rotor head to the surface of the workpiece is set as a function of signals received by the control unit from of the scale detection unit.

17. The device of claim 1, wherein the at least one rotor head comprises a first rotor head and a second rotor head respectively arranged above and below the moving workpiece, wherein the liquid dispensed onto the workpiece by the respective jet nozzles of the first and second rotor heads are set at different pressures.

18. A method for descaling a workpiece which is in motion in a movement direction in relation to a device having at least one rotor head rotatable about an axis of rotation, the at least one rotor head having at least one jet nozzle directed towards the workpiece, the method comprising:

rotating the at least one rotor head about an axis of rotation;

dispensing a liquid at a predetermined pressure from the at least one jet nozzle while the at least one rotor head is rotated about its axis of rotation onto the workpiece at an angle of attack ($\alpha$) that is inclined to the surface of the workpiece, wherein a spraying direction of the liquid dispensed from the at least one jet nozzle, with respect to a projection in a plane parallel to the surface of the workpiece is at a spraying angle ($\beta$) in a range between 170° and 190° with respect to the movement direction (X) of the workpiece, and the angle of attack ($\alpha$) for the at least one jet nozzle remains constant; and collecting the liquid dispensed from the jet nozzles, after rebounding from the surface of the workpiece, and scale particles removed by the pressurized liquid from the surface of the workpiece into a collection unit.

19. The method of claim 11, further comprising adjusting, via a control unit, a rotational speed at which the at least one rotor head is rotated about its axis of rotation based on a feed velocity at which the workpiece is in motion in the movement direction.

20. The method of claim 11 further comprising controlling volume flow of liquid sprayed out of the at least one jet nozzle ($\dot{V}_1$; $\dot{V}_2$; $\dot{V}_3$).

21. The method of claim 20, wherein the at least one jet nozzle comprises a plurality of jet nozzles attached to the at least one rotor head, the plurality of jet nozzles being spaced apart at different radial distances ($s_1$; $s_2$; $s_3$) from the axis of rotation of the at least one rotor head, the method further comprising:

controlling volume flows of different amounts of liquid sprayed out of the plurality of jet nozzles, wherein a greater volume flow ($\dot{V}_1$; $\dot{V}_2$; $\dot{V}_3$) of liquid is sprayed from a jet nozzle which has a greater radial distance to the axis of rotation than a second jet nozzle having a smaller radial distance to the axis of rotation.

* * * * *